US008998122B2

(12) United States Patent
Weiss et al.

(10) Patent No.: US 8,998,122 B2
(45) Date of Patent: Apr. 7, 2015

(54) WINDER FOR FILM TRIM WINDING

(75) Inventors: Klaus Weiss, Bad Groenenbach (DE); Elmar Ehrmann, Bad Groenenbach (DE); Guenther Braeckl, Oberguenzburg (DE)

(73) Assignee: Multivac Sepp Haggenmueller GmbH & Co. KG, Wolfertschwenden (DE)

( * ) Notice: Subject to any disclaimer, the term of this patent is extended or adjusted under 35 U.S.C. 154(b) by 258 days.

(21) Appl. No.: 13/365,684

(22) Filed: Feb. 3, 2012

(65) Prior Publication Data

US 2012/0199685 A1 Aug. 9, 2012

(30) Foreign Application Priority Data

Feb. 4, 2011 (DE) ..... 10 2011 010 378

(51) Int. Cl.

| | |
|---|---|
| ***B65H 23/06*** | (2006.01) |
| ***B65H 23/195*** | (2006.01) |
| ***B65H 18/10*** | (2006.01) |
| ***B65H 75/24*** | (2006.01) |

(52) U.S. Cl.

CPC ..... *B65H 23/195* (2013.01); *B65H 18/106* (2013.01); *B65H 75/242* (2013.01); *B65H 2403/731* (2013.01); *B65H 2403/732* (2013.01); *B65H 2405/45* (2013.01); *B65H 2801/81* (2013.01); *B65H 2301/4148* (2013.01)

(58) Field of Classification Search

USPC ..... 242/422, 422.2

See application file for complete search history.

(56) References Cited

U.S. PATENT DOCUMENTS

| | | | | |
|---|---|---|---|---|
| 2,045,059 | A * | 6/1936 | Tomlin | 242/422 |
| 2,364,808 | A * | 12/1944 | Nelson | 57/58.54 |
| 4,063,692 | A | 12/1977 | Buggy | |
| 4,307,851 | A | 12/1981 | Dunaevsky et al. | |
| 5,137,224 | A | 8/1992 | Peters et al. | |
| 5,884,860 | A * | 3/1999 | Ishikawa et al. | 242/422 |
| 5,971,314 | A | 10/1999 | Essert | |
| 6,357,691 | B1 | 3/2002 | Watanabe et al. | |
| 6,883,746 | B2 | 4/2005 | Murachi et al. | |
| 7,246,766 | B2 * | 7/2007 | Shibukawa et al. | 242/422.2 |
| 7,281,677 | B2 * | 10/2007 | Anderson | 242/422.2 |

FOREIGN PATENT DOCUMENTS

| | | | |
|---|---|---|---|
| DE | 1201650 | B | 9/1965 |
| DE | 1922848 | A1 | 11/1970 |
| DE | 2726321 | A1 | 12/1977 |
| DE | 19709078 | A1 | 9/1998 |
| DE | 69933144 | T2 | 12/2006 |
| DE | 60119163 | T2 | 2/2007 |
| EP | 0351511 | A1 | 1/1990 |
| EP | 0437751 | A2 | 7/1991 |
| EP | 0863101 | A2 | 9/1998 |
| EP | 0994054 | A2 | 4/2000 |
| EP | 1655258 | A2 | 5/2006 |
| JP | 60204552 | A | 10/1985 |

OTHER PUBLICATIONS

German Office Action Dated Aug. 24, 2011, Applicant MULTIVAC Sepp Haggenmueller GmbH & Co. KG, Application No. 10 2011 010 378.3.

* cited by examiner

*Primary Examiner* — Sang Kim

(74) *Attorney, Agent, or Firm* — Husch Blackwell LLP

(57) ABSTRACT

The disclosure relates to a winder for winding film trims for packaging machines. The winder comprises a drive, a winding mandrel and at least two winding rolls. The disclosure is characterized by an adjustment device for adjusting a torque threshold above which slip occurs between the respective winding rolls and the winding mandrel and/or between the individual winding rolls.

16 Claims, 4 Drawing Sheets

WINDER FOR FILM TRIM WINDING

CROSS-REFERENCE TO RELATED APPLICATIONS

This application claims foreign priority benefits under 35 U.S.C. §119(a)-(d) to German patent application number DE 10 2011 010 378.3, filed Feb. 4, 2011, which is incorporated by reference in its entirety.

TECHNICAL FIELD

The disclosure relates to a winder for winding film trims, i.e., remains of a film or foil, for packaging machines.

BACKGROUND

A winder of a thermoform packaging machine for winding waste trims, such as edge trims and middle trims, is disclosed by DE 1922848. The winder is provided with a shaft which is driven by a cutting unit and on which one or a plurality of tubular winding formers rest with their inner diameter. During winding, slip occurs between the winding formers and the driven shaft. This slip may be different for the respective winding formers, e.g., in view of differently wound-up waste trims. This known winder is disadvantageous insofar as the slip is undefined and varies substantially during winding and insofar as the winding formers must be disposed of together with the wound-up waste trims.

In addition, thermoform packaging machines are known, which, in an area in which a web feed releases a web to be conveyed, are provided with a respective edge trim winder on either side. Each edge trim winder is driven by a separate motor and activated for a certain period of time for the purpose of winding. Likewise, tray sealers are known, which wind up a residual film grid of the lidding web by means of a winder.

SUMMARY

It is an object of the present disclosure to improve a winder for a packaging machine with respect to its use for winding waste trims and/or residual film grids.

A winder according to the present disclosure which is used for winding film trims for packaging machines, preferably for thermoform packaging machines, comprises a drive, a winding mandrel and at least two winding rolls, and it is provided with an adjustment device for adjusting a torque threshold above which slip occurs between the respective winding rolls and the winding mandrel and/or between the individual winding rolls. The adjustment device comprises coupling elements via which the winding mandrel transmits a torque to the winding rolls, and offers a machine operator the possibility of raising or lowering the torque threshold in accordance with the present disclosure.

An advantage resides here, on the one hand, in the fact that a common drive is provided for a plurality of winding rolls, said drive transmitting its torque to the winding mandrel and the winding mandrel transmitting the torque to the winding rolls via coupling elements. Above the adjusted torque limit, slip may occur on the winding rolls independently of one another. The torque limit limits the maximum tension force acting on a waste trim or a residual film grid. When the drive of the packaging machine is running and the feed thereof is standing still, winding up of the waste trims or the residual film grid cannot be continued and the winding rolls can stop, even at different moments in time, since the torque threshold is exceeded and the desired slip occurs, without the necessity of switching off the drive at this moment. The winding rolls may rotate at different speeds also during the winding operation. The adjustment of the torque threshold and, consequently, of the tension force acting on the waste trims or the residual film grid allows an adaptation to the characteristics of the material of said waste trims or said residual film grid and leads to an improved process reliability during winding up.

Preferably, the adjustment device comprises a plurality of coupling rings arranged laterally and/or between the winding rolls. This allows a simple and low-cost structural design.

The coupling rings are preferably made of POM (polyoxymethylene), which is allowed to be used in the foodstuff industry.

According to a preferred embodiment, an adjustment wheel for axially compressing the coupling rings and the winding rolls is provided on the winding mandrel so that the slip can be adjusted continuously and easily by an operator of the packaging machine.

According to a particularly advantageous embodiment, the adjustment wheel is arranged on an end of the winding mandrel that is located opposite the drive, since it is then provided on the side from which the packaging machine is operated, and is therefore very easily accessible.

Preferably, a spring element is provided on the winding mandrel between the drive and the winding rolls, the adjustment wheel being movable against the spring element so as to raise the torque threshold. This allows a very exact adjustment of the torque threshold which the winding rolls have in common; said torque threshold can nevertheless lead to a slip on the winding rolls at different moments in time.

Also an adjustment device comprising at least two cooperating permanent magnets is of advantage. Such a magnetic coupling works free from wear even if the drive is operating continuously. Another advantage resides in the fact that permanent magnets need not be supplied with energy.

According to a preferred embodiment, the permanent magnets are adapted to be adjusted relative to one another in the axial direction of the winding mandrel so as to adjust the torque threshold of the winding rolls to the winding mandrel.

It is also advantageous when the winding roll is provided with a bevel on the outer diameter thereof so as to allow a user-friendly removal of the wound-up film trim.

The winding rolls preferably comprise a plurality of roll elements, which can be forced apart radially to the winding mandrel by means of laterally arranged and axially displaceable tensioning elements. It is thus possible to adjust, prior to the winding operation, the roll elements to a maximum outer diameter of the winding roll and to reduce, after winding, the roll elements to a smaller outer diameter so that the film trims can be removed easily.

According to a particularly suitable embodiment, the tensioning element which is most remote from the drive is adapted to be removed from the winding mandrel so that a wound-up film trim can be removed axially from the unit.

Preferably, the drive can be switched off temporarily by means of a controller of the packaging machine so as to save power and, in cases in which coupling rings are used, minimize wear.

In the following an advantageous embodiment of the disclosure will be explained in more detail with reference to the below drawings.

DETAILED DESCRIPTION

Figure 1:
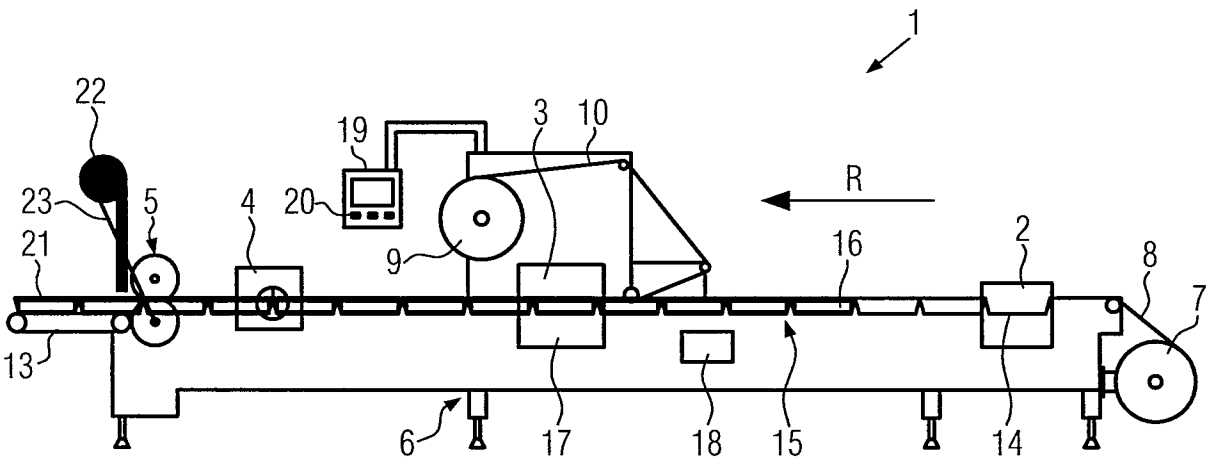
FIG. 1 is a schematic side view of a thermoform packaging machine with a winder according to the present disclosure.

Similar components are designated with like reference numerals throughout the drawings.

FIG. 1 shows a schematic view of a packaging machine 1 in the form of a thermoform packaging machine. This thermoform packaging machine 1 comprises a forming station 2, a sealing station 3, a transverse cutting unit 4 and a longitudinal cutting unit 5, which are arranged in this order in a working direction R on a machine frame 6.

On the input side, a supply roll 7 is provided on the machine frame 6, from which a first web-shaped material 8 is unwound. In the area of the sealing station 3, a material storage unit 9 is provided, from which a second web-shaped material 10 is unwound as a lidding web. On the output side, a discharge device 13 in the form of a conveyor belt is provided at the packaging machine, with which finished, singulated packages are transported away. Furthermore, the packaging machine 1 comprises a feeding device which is not shown, said feeding device gripping the first web-shaped material 8 and transporting it cyclically in a main work cycle in the working direction R. The feeding device can be realized, for example, by laterally arranged transport chains.

In the embodiment shown, the forming station 2 is configured as a thermoforming station in which containers 14 are formed in the first web-shaped material 8 by thermoforming. The forming station 2 can be configured such that in the direction perpendicular to the working direction R several containers are formed side by side. An infeed line 15, along which the containers 14 formed in the first web-shaped material 8 are filled with a product 16, is arranged downstream of the forming station 2 in the working direction R.

The sealing station 3 is provided with a closable chamber 17 in which the atmosphere in the container 14 can, prior to sealing, be substituted by a substitute gas or a substitute gas mixture, e.g., by means of gas flushing.

The cross cutting unit 4 is implemented as a punch which cuts through the first web-shaped material 8 and the second web-shaped material 10 between neighbouring containers 14 in a direction transversely to the working direction R. In so doing, the cross cutting unit 4 works such that the first web-shaped material 8 is not cut through across the whole width thereof, but remains uncut at least in a boundary area thereof. This allows controlled further conveyance by the feeding device.

In the embodiment shown, the longitudinal cutting unit 5 is implemented as a knife unit by means of which the first web-shaped material 8 and the second web-shaped material 10 are cut through between neighbouring containers 14 and at the lateral boundary of the first web-shaped material 8 so that singulated packages 21 are obtained downstream of the longitudinal cutting unit 5. The film trims released by the feeding device on either side are wound up as edge trims 23 by a winder 22 according to the present disclosure.

The packaging machine 1 is additionally provided with a controller 18. This controller 18 has the function to control and monitor the processes taking place in the packaging machine 1. A display device 19 with control elements 20 is used for visualizing for and influencing by an operator the sequences of processes taking place in the packaging machine 1.

Figure 2:
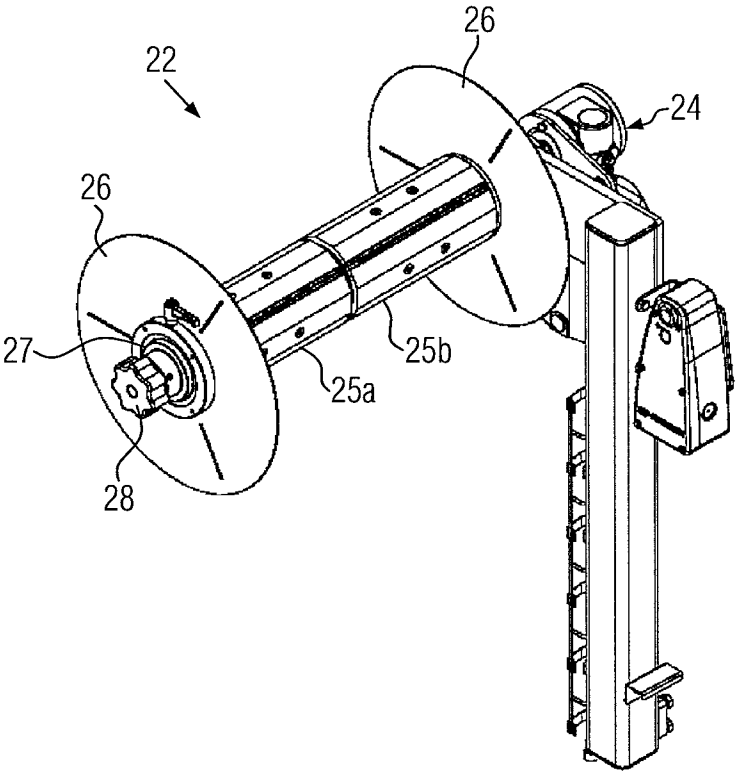
FIG. 2 is a schematic view of a winder.

FIG. 2 shows a winder 22 with its drive 24 and two winding rolls 25*a*, 25*b*. The winder 22 comprises stop discs 26, which are provided on tensioning elements 27, and an adjustment wheel 28 for adjusting the torque threshold.

Figure 3:
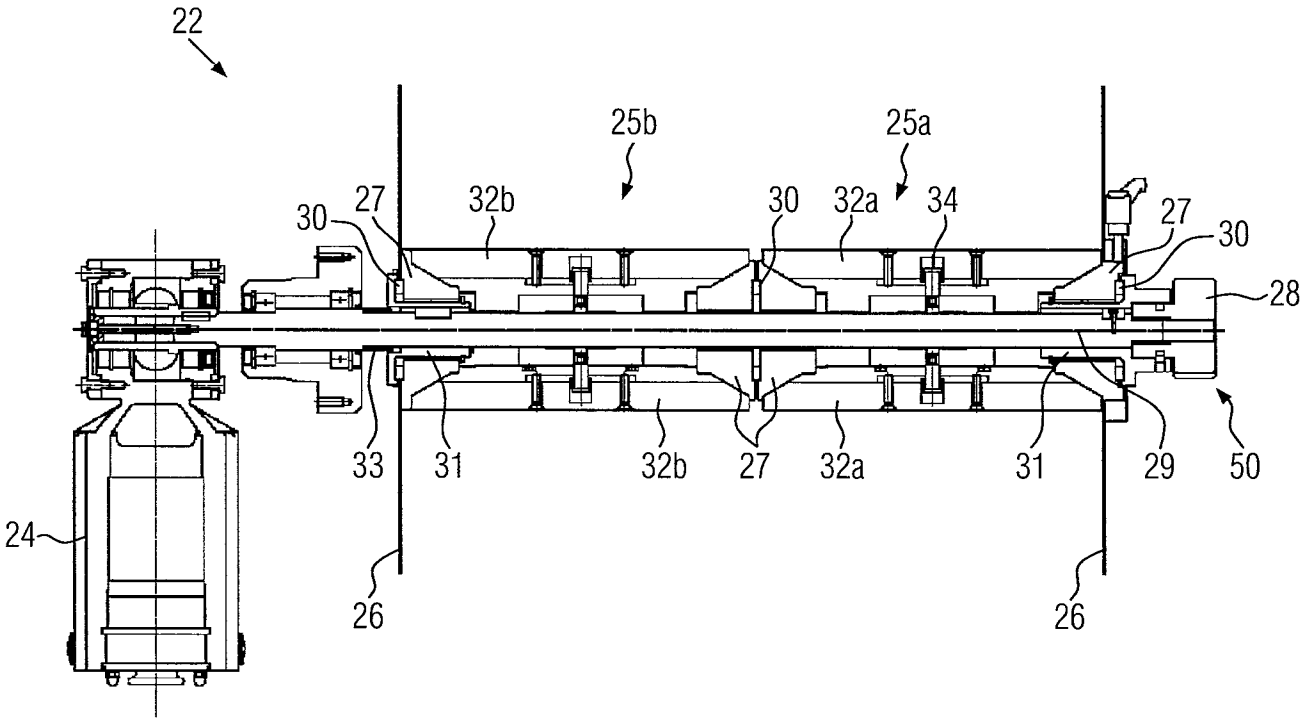
FIG. 3 is a sectional view of a winder.

FIG. 3 shows the winder 22 with its winding mandrel 29. An adjustment device 50 comprises an adjustment wheel 28, a coupling ring 30 between two tensioning elements 27 of the two winding rolls 25*a* and 25*b*, and two additional coupling rings 30 which are arranged between the outer tensioning elements 27 and drive bushings 31 that are connected to the winding mandrel 29 by means of fitting keys such that they are secured against rotation relative thereto. The drive 24, e.g., a servomotor, transmits its torque to the winding mandrel 29 and the tensioning elements 27 which are provided on said winding mandrel 29 such that they are secured against rotation relative thereto. Via an axial bias of the tensioning elements 27, the coupling rings 30 and the roll elements 32*a*, 32*b*, the torque is transmitted to the winding rolls 25*a*, 25*b*.

In the following, the mode of operation is described in detail. The adjustment wheel 28 can be screwed onto the winding mandrel 29 and forces the outer drive bushing 31 via the outer coupling ring 30 against the outer tensioning element 27 and then against the roll elements 32*a* of the outer winding roll 25*a* and the additional tensioning element 27. This has the effect that the roll elements 32*a* are displaced radially outwards until they are stopped by a stop 34. Analogously, this also happens with the roll elements 32*b* of the inner winding roll 25*b*. When the roll elements 32*a* and 32*b* have been stopped by stops 34, the adjustment wheel 28 acts via the outer coupling ring 30 and via the winding roll 25*a* on the central coupling ring 30 and via the winding roll 25*b* on the inner coupling ring 30 and via an inner drive bushing 31 onto a spring 33 which is compressed in this way. By further displacing the adjustment wheel 28 in the direction of the drive 24, the spring 33 is compressed still further and the force, which equally acts on the coupling rings 30, is increased, which has the effect that the torque threshold is raised and the maximum tension force applied to the film trim 23 is increased.

If edge trims 23 should be wound differently on the respective winding rolls 25*a*, 25*b*, the existing slip guarantees that the winding rolls 25*a*, 25*b* can rotate differently in relation to the winding mandrel 29 and the drive 24, respectively.

The coupling rings 30 may be made of POM, which is allowed to be used in the foodstuff industry, or of any other suitable material, such as a material which is suitable to vary, by varying the axially applied pressure, the frictional force proportionally to the greatest possible extent.

The embodiment of the winder 22 is not limited to two winding rolls 25*a*, 25*b*. If the packaging machine in question is, e.g., a 3-track thermoform packaging machine 1 with additional middle trim cuts between the tracks, two edge trims 23 and two middle trims will have to be wound up, and the winder 22 will therefore preferably comprise four winding rolls 25*a*, 25*b*. The individual winding rolls 25*a*, 25*b* may have different widths.

Irrespectively of the number of winding rolls 25*a*, 25*b*, a residual film grid can be wound up instead of a plurality of edge trims 23, without retooling of the winder 22 being necessary.

Figure 4:
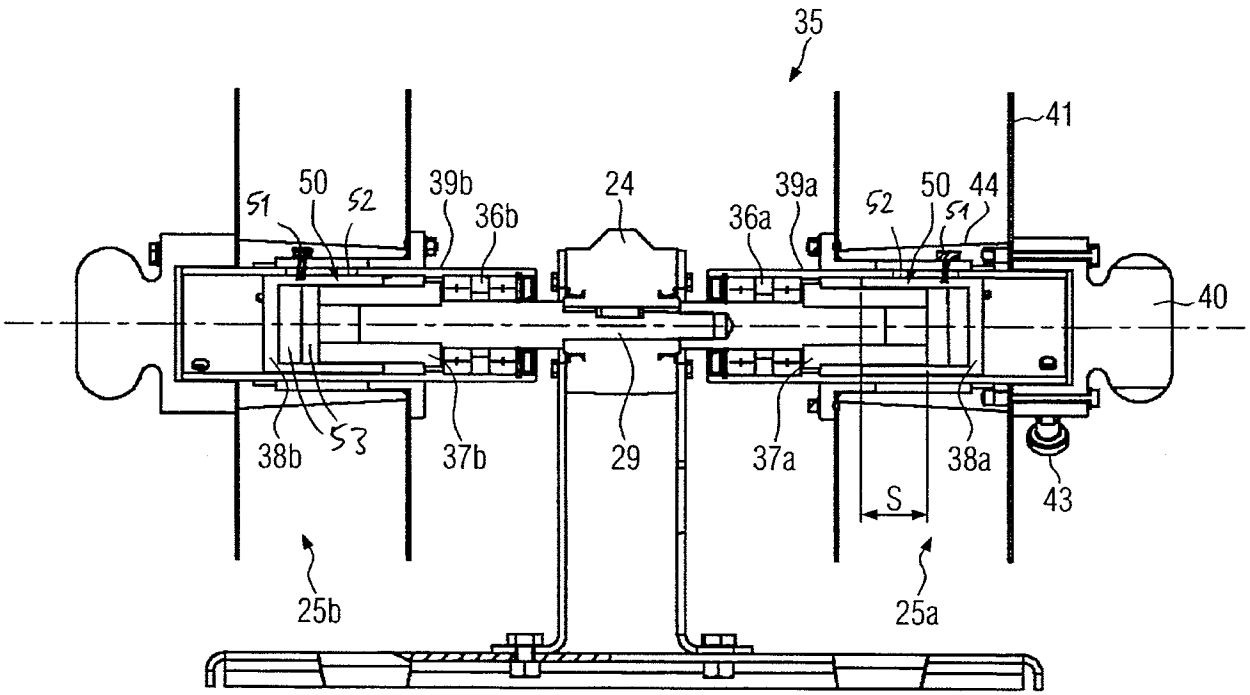
FIG. 4 is a variant of a winder.

FIG. 4 shows a variant of a winder 35 with two cantilever winding shafts 25*a*, 25*b* and a centrally arranged drive 24. Each of the winding rolls 25*a*, 25*b* is supported on the winding mandrel 29 via a bearing 36*a*, 36*b*. A respective permanent magnet 37*a*, 37*a* is arranged on the winding mandrel 29 on either side of the drive 24 such that it is secured against rotation relative to the winding mandrel 29. A permanent countermagnet 38*a*, 38*b* is provided in a respective bushing 39*a*, 39*b*, which is supported above the bearing 36*a*, 36*b*. The overlap S of the inner magnet 37*a*, 37*b* and of the countermagnet 38*a*, 38*b* determines the torque threshold of the winding roll 25*a*, 25*b* relative to the winding mandrel 29 above which slip will occur. The overlap S can be adjusted via an axial adjustment of the countermagnet 38*a*, 38*b* in the bushing 39*a*, 39*b*. The larger the overlap S between the inner magnet 37*a*, 37*b* and the corresponding countermagnet 38*a*, 38*b*, the larger is the torque threshold above which slip occurs, and the larger are the achievable winding forces—and vice versa.

In order to be able to adjust the overlap S, any suitable arrangement or mechanism may be utilized. For example, fixing members such as fixing screws 51 may be provided, each inserted into an oblong hole 52 with an axial direction in the respective bushing 39*a*, 39*b*, and being screwed with a suitable thread into a hole in the respective countermagnet 38*a*, 38*b*. When the fixing screw 51 is loosened, it may be displaced manually within the oblong hole 52 in the axial direction, taking along with it the corresponding countermagnet 38*a*, 38*b* and thereby adjusting the overlap S. At a desired position, the screw 51 may be tightened again.

Optionally, a variable number of stop or limiting members, such as intermediate disks 53, may be interposed in the axial space between the inner magnet 37*a*, 37*b* and the corresponding countermagnet 38*a*, 38*b*, in order to limit the maximum achievable overlap S. Alternatively, this space may be empty.

In another embodiment, a drive, for example a servo motor, is provided for adjusting the axial position of the countermagnet 38*a*, 38*b*, and with it the overlap S.

For removing a wound-up film trim 23 from the winder 35, the winding roll 25*a* can be removed axially from the winding mandrel 29 with a stop disc 41 and a handle 40, when a locking pin 43 has been released. This applies analogously to the winding roll 25*b*. The film trim 23 can easily be pulled off via a bevel 44 on the outer diameter of the winding roll 25*a*, 25*b*.

The permanent magnets 37*a*, 37*b*, 38*a*, 38*b* may alternatively also be implemented as electromagnets, at least partially.

The disclosure relates not only to the variants shown in the figures, but, e.g., also to the combination of magnets 37*a*, 37*b*, 38*a*, 38*b* in a winder 22 with two winding rolls 25*a*, 25*b* of the type shown in FIG. 3, or to the combination of coupling rings 30 in a winder 35 with winding rolls 25*a*, 25*b* on a central drive 24 arranged in the way shown in FIG. 4. As has been explained, it is additionally possible to provide more than two winding rolls 25*a*, 25*b*.

While exemplary embodiments are described above, it is not intended that these embodiments describe all possible forms of the invention. Rather, the words used in the specification are words of description rather than limitation, and it is understood that various changes may be made without departing from the spirit and scope of the invention. Additionally, the features of various implementing embodiments may be combined to form further embodiments of the invention.

What is claimed is:

1. A packaging machine comprising:

a winder for winding film trims, the winder comprising:

a winding mandrel;

a drive for driving the winding mandrel;

at least two winding rolls associated with the winding mandrel; and an adjustment device for adjusting a torque threshold above which slip occurs between the respective winding rolls and the winding mandrel, wherein the adjustment device comprises at least two cooperating permanent magnets disposed in a relative position in an axial direction of the winding mandrel and wherein the adjustment device is operable to adjust a position of at least one of the at least two cooperating permanent magnets in the axial direction of the winding mandrel to vary the relative position of the at least two cooperating permanent magnets.

2. A winder according to claim 1 wherein the adjustment device comprises a plurality of coupling rings arranged laterally and/or between the winding rolls.

3. A winder according to claim 2 wherein the coupling rings are made of polyoxymethylene.

4. A winder according to claim 2 wherein the adjustment device further comprises an adjustment wheel provided on the winding mandrel for axially compressing the coupling rings and the winding rolls.

5. A winder according to claim 4 wherein the adjustment wheel is arranged on an end of the winding mandrel that is located opposite the drive.

6. A winder according to claim 2 further comprising a spring element that is provided on the winding mandrel between the drive and the winding rolls, wherein the adjustment wheel is movable against the spring element so as to raise the torque threshold.

7. The packaging machine according to claim 1 wherein the winding rolls are provided with a bevel for facilitating removal of a wound-up film trim.

8. The packaging machine according to claim 1 further comprising an adjustment mechanism for adjusting a first one of the at least two cooperating permanent magnets relative to a second one of the at least two cooperating permanent magnets.

9. The packaging machine according to claim 8 wherein the adjustment mechanism comprises at least one limiting member that is selectively positionable between the first and second at least two cooperating permanent magnets in order to adjust relative position of the first and second at least two cooperating permanent magnets.

10. The packaging machine according to claim 8 wherein the adjustment mechanism comprises multiple limiting members that are selectively positionable between the first and second at least two cooperating permanent magnets in order to adjust relative position of the first and second at least two cooperating permanent magnets.

11. The packaging machine according to claim 8 wherein the adjustment mechanism comprises a drive.

12. A winder according to claim 1 further comprising multiple laterally arranged and axially displaceable tensioning elements associated with the winding mandrel, wherein each winding roll comprises a plurality of roll elements that can be forced apart radially with respect to the winding mandrel by the tensioning elements.

13. A winder according to claim 12 wherein the multiple tensioning elements include a first tensioning element that is most remote from the drive, and wherein the first tensioning element is adapted to be removed from the winding mandrel so that a wound-up film trim can be removed axially from the winder.

14. The packaging machine according to claim 1 wherein the drive can be switched off temporarily by means of a controller of the packaging machine.

15. A packaging machine comprising:

a winder for winding film trims, the winder having a winding mandrel;

a drive for driving the winding mandrel;

at least two winding rolls associated with the winding mandrel; and an adjustment device for adjusting a torque threshold above which slip occurs between the respective winding rolls and the winding mandrel, wherein the adjustment device comprises at least two cooperating permanent magnets in a relative position in an axial direction of the winding mandrel, and wherein the at least two cooperating permanent magnets overlap an overlap distance in the relative position and wherein the torque threshold is determined by the overlap distance, and wherein the adjustment device is operable to vary the overlap distance to adjust the torque threshold.

16. A packaging machine comprising:

a winder for winding film trims, the winder comprising;

a winding mandrel;

a drive for driving the winding mandrel;

at least two winding rolls associated with the winding mandrel;

an adjustment device for adjusting a torque threshold above which slip occurs between the respective winding rolls and the winding mandrel, wherein the adjustment device comprises at least two cooperating permanent magnets; and an adjustment mechanism for adjusting a first one of the permanent magnets relative to a second one of the permanent magnets, wherein the adjustment mechanism includes a fixing member for fixing a position of the first permanent magnet with respect to a position of the second permanent magnet, wherein the fixing member is configured to be adjusted to allow movement of the first permanent magnet with respect to the second permanent magnet.

* * * * *